United States Patent [19]

Rodormer

[11] 3,937,607

[45] Feb. 10, 1976

[54] POST-TENSIONING ANCHORS ASSEMBLED IN COMBINATION WITH A SPACER STRIP

[75] Inventor: George W. Rodormer, Lighthouse Point, Fla.

[73] Assignee: Reliable Electric Company, Franklin Park, Ill.

[22] Filed: July 3, 1972

[21] Appl. No.: 268,531

[52] U.S. Cl. ..... 425/111; 52/223 L; 249/210; 403/369

[51] Int. Cl.[2] ..... B28B 23/04

[58] Field of Search ..... 425/65, 111, 188; 249/30, 249/38, 42–47, 190, 191, 196, 213, 217, 91, 21 D; 33/185, 189; 264/228, 229; 52/223 L; 403/369

[56] References Cited

UNITED STATES PATENTS

| | | | |
|---|---|---|---|
| 1,162,554 | 11/1915 | Berry | 249/38 |
| 2,234,663 | 3/1941 | Anderegg | 425/111 |
| 3,399,434 | 9/1968 | Kelly | 425/111 |

FOREIGN PATENTS OR APPLICATIONS

| | | | |
|---|---|---|---|
| 698,643 | 10/1953 | United Kingdom | 33/189 |

*Primary Examiner*—Ronald J. Shore
*Assistant Examiner*—John McQuade
*Attorney, Agent, or Firm*—Olson, Trexler, Wolters, Bushnell & Fosse, Ltd.

[57] ABSTRACT

Post-tensioning apparatus for cast concrete comprises dead end and live end anchors adjacent to the casting forms for gripping and post-tensioning reinforcing tendons. A group of dead end anchors are preassembled with a flexible plastic strip, and likewise a group of live end anchors are preassembled with a flexible plastic strip. The strips permit preset spacing of the anchors so that each assembly of anchors can be secured to the associated form with accurate spacing provided for respective dead and live anchors in the setup.

5 Claims, 6 Drawing Figures

FIG.4
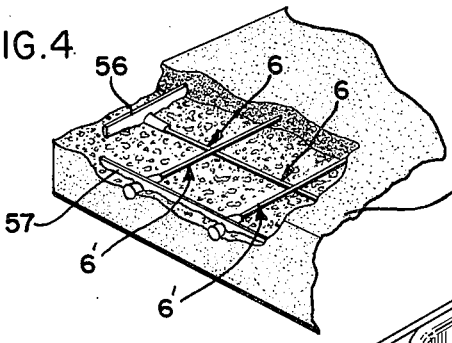
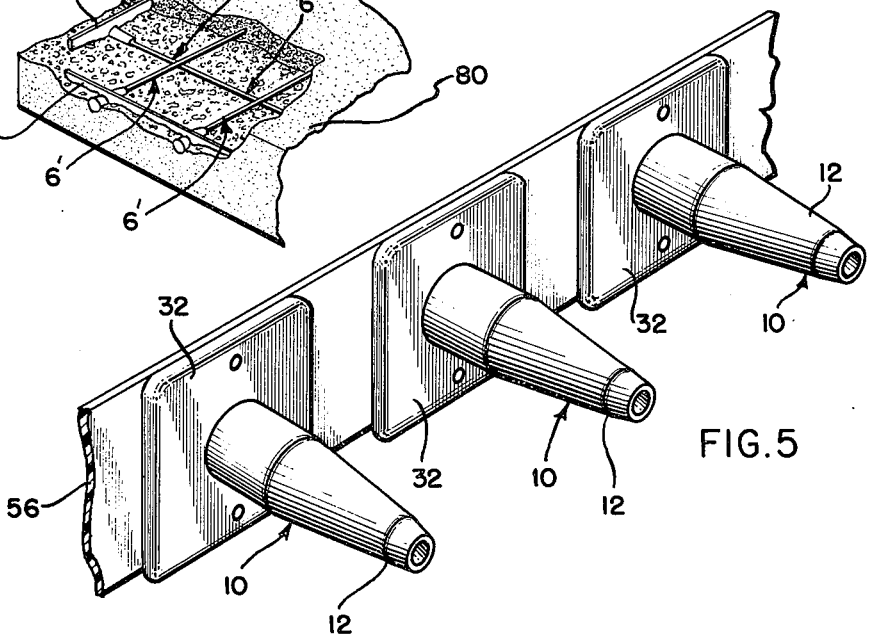
FIG.5
FIG.6
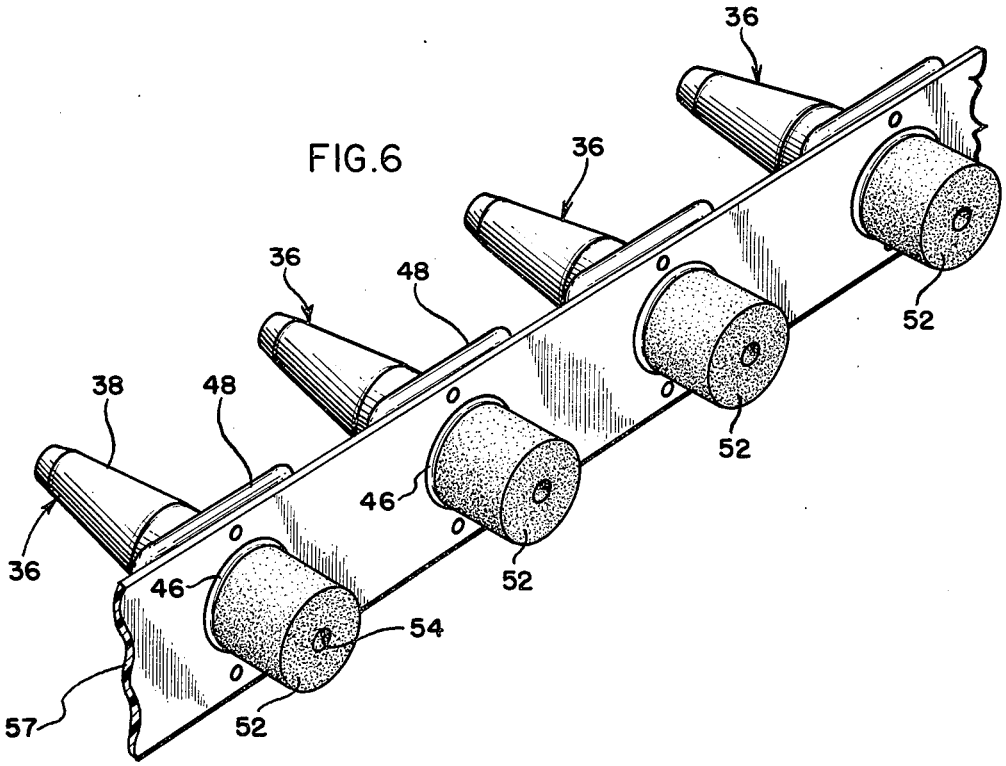

POST-TENSIONING ANCHORS ASSEMBLED IN COMBINATION WITH A SPACER STRIP

BACKGROUND OF THE INVENTION

This invention relates to apparatus for casting concrete, and more particularly to apparatus for post-tensioning the concrete.

In the casting and post-tensioning of concrete, it is customary to attach the dead end anchors and live end anchors to their respective forms so that each dead end anchor is in alignment with one of the live end anchors. This procedure usually requires the workman to nail each anchor to its associated form, taking care to insure that the respective dead end and live end anchors are in alignment. For relatively large slabs or a large number of slabs at a job site, the foregoing procedure can be relatively expensive in terms of labor costs since the center-to-center spacing of the anchors on a form must be accurately maintained. This means that careful measurements must be made for each installation of an anchor.

OBJECTS AND SUMMARY OF THE INVENTION

It is an object of this invention to provide an apparatus for casting and post-tensioning concrete which is simple to install and which results in savings of time and labor over existing processes and apparatus for like purposes.

A further object of this invention is to provide an apparatus of the type stated which facilitates accurate positioning of the dead end and live end anchors so as to insure that the tendons running between opposed forms are truly parallel.

Another object of this invention is to provide an apparatus of the type stated which is particularly economical when used in connection with the casting of a large number of concrete slabs or other structural members of similar configuration and wherein the spacing between adjacent tendons is intended to be uniform throughout the castings.

Another important object of this invention is to provide a unique manner of securing dead end or live end tendon anchors to a flexible strip whereby groups of anchors may be prepackaged at the place of manufacture for subsequent use in the field, and wherein the prepackaged strips with anchors thereon may be readily nailed to the casting forms.

In accordance with the foregoing objects of the invention comprises opposed forms between which the concrete is cast, for example, where the slab is one that is poured on grade. The invention, however, not limited to slabs poured on grade but may be embodied in a variety of structural members. A plurality of dead end anchors are adjacent to one of the forms, each anchor having a casing with a chuck therein for gripping a reinforcing tendon. A flexible strip is secured to the casings of the anchors to position the casings at predetermined spacings such that the longitudinal axes of the respective casings and chucks therein are perpendicular to the strip. The live end anchors are positioned adjacent to the other form end, and each live end anchor also has a casing with a chuck therein for gripping a reinforcing tendon. Likewise, the live end anchors are secured to a flexible strip so that the longitudinal axes of the live end casings and chucks therein are perpendicular to the associated flexible strip. Each flexible strip is preassembled with a group of anchors so that the strips and anchors may be quickly nailed to the forms to position each dead end anchor in accurate axial alignment with a live end anchor. Since the anchors are spaced apart a predetermined distance along the associated flexible strip, an accurate spacing of the anchors is provided and there is no need to measure the distance between adjacent anchors prior to installation of each anchor on a form.

BRIEF DESCRIPTION OF THE FIGURES

FIG. 4 is a fragmentary perspective view, partially broken away, of the completed casting;

FIG. 5 is a fragmentary perspective view showing a number of dead end anchors attached to a plastic strip; and FIG. 6 is a fragmentary perspective view showing a number of live end anchors attached to a plastic strip.

DETAILED DESCRIPTION

Figure 1:
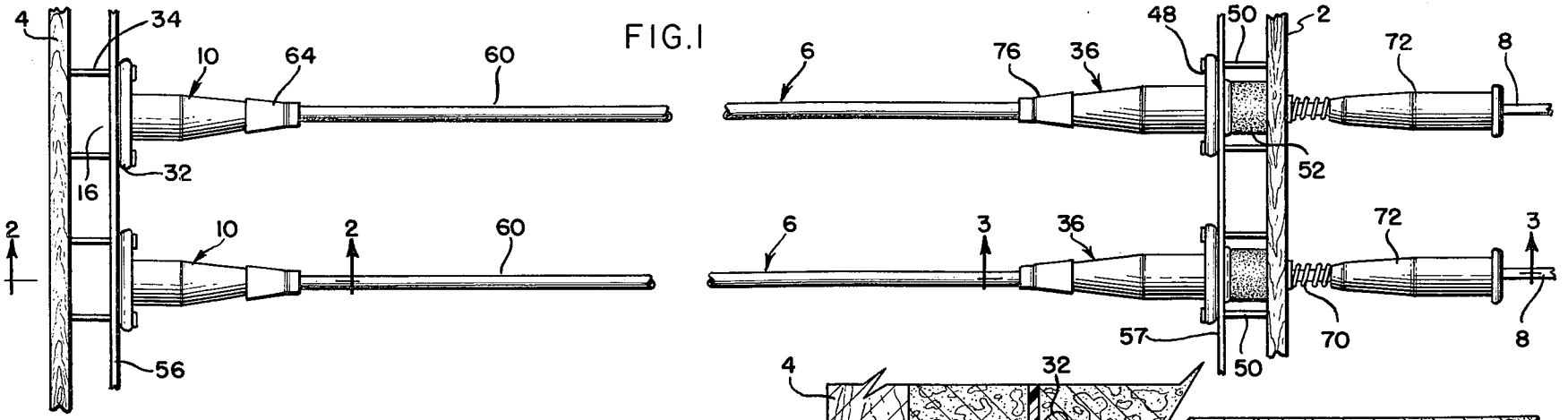
FIG. 1 is a fragmentary top plan view of apparatus constructed in accordance with and embodying the present invention.

Referring now in more detail to the drawing, which illustrates a preferred embodiment of the present invention, there is illustrated an apparatus that includes opposed forms 2, 4 between which concrete is poured. Only fragmentary portions of the forms are shown, it being understood that they will conform to the shape of the casting. Furthermore, in the typical case of a concrete slab, there will be a pair of forms at right angles to the forms 2, 4. Extending between the forms 2, 4 are post-tensioning assemblies 6 that include parallel tendons 8 of wire rope, synthetic rope, or the like. Like tensioning assemblies 6' (FIG. 4), running between the other set of forms, will generally be perpendicular to the assemblies 6. Thus, in the typical rectangular slab 80, the tendons of the tensioning assemblies 6, 6' will form a generally rectangular grid.

The dead end anchor 10 may be of any known type, for instance that shown in Kelly U.S. Pat. No. 3,399,434. Suffice it to say, however, that the anchor 10 comprises a casing 12 having a cylindrical forward section 14 that terminates in the radial end flange 16. The casing 12 also has a rearwardly tapering frustoconical portion 18. Within the tapering bore of the casing is a chuck 20 in the form of a jaw cluster, preferably comprising three arcuate, elongated and tapered jaw segments which define a central bore having teeth 22. The segments of the jaw cluster are held together at their larger diameter ends by a resilient band 24. The anchor 10 also includes at its forward end a closure cap 26 which prevents the entrance of concrete into the casing 12. At the forward end of the chuck 20 is a cup 28 that exerts axial pressure on the jaw segments urging them to a closed position. Pressure on the cup 28 is, in turn, provided by a helical spring 30 between the closure cap 26 and the cup 28. On the exterior of the casing at the cylindrical portion 14 is a thrust plate 32 having holes for receiving nails 34. The nails are used to secure the anchors 10 to the form 4 but in inwardly spaced relationship thereto. If desired, one or more secondary thrust plates (not shown) may be mounted on the exterior of the frusto-conical portion 18 parallel to the thrust plate 32.

Figure 3:
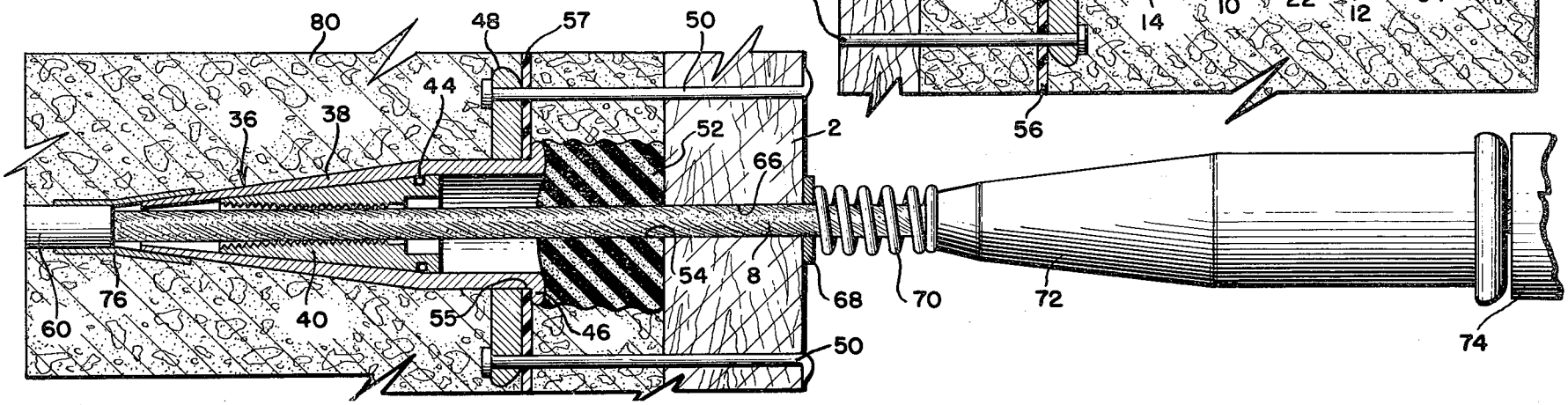
FIG. 3 is a fragmentary sectional view, on an enlarged scale, taken along line 3—3 of FIG. 1, and also showing the apparatus after the concrete has been poured.

Referring to FIG. 3, the live end anchor 36 may also be similar to that shown in the aforesaid Kelly Patent. The anchor 36 comprises a casing 38 and a jaw cluster chuck 40 in the tapered casing bore. The jaw segments are held together by an annular band 44, similar to the arrangement in the dead end anchor 10. Likewise, the casing 36 has a radial end flange 46 and a thrust plate 48, both similar to the end flange 16 and thrust plate 32, previously described. Like the thrust plate 32 the thrust plate 48 receives nails 50 for securing the live end anchor 36 in spaced relationship to the form 2. The live end anchor 36 also includes a coaxial resilient spacer 52 having a central bore 54. The spacer 52 is bonded to the forwardly presented face of the end flange 46. As will be apparent hereafter, the spacer 52 serves to seal the casing 38 against the entrance of concrete. As with the dead end anchor, the live end anchor 36 may also have a secondary thrust plate.

Figure 2:
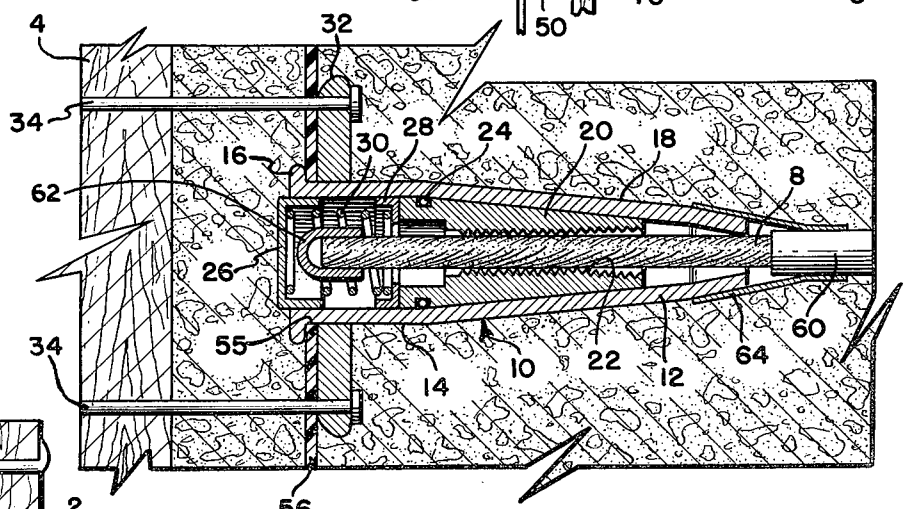
FIG. 2 is a fragmentary sectional view, on an enlarged scale, taken along line 2—2 of FIG. 1 but showing the apparatus after the concrete has been poured.

It will be noted that each of the dead end anchors 10 is mounted at its larger diameter end on a plastic strip 56. The plastic strip 56 is perforated, preferably uniformly therealong, with holes 55 of a size that permit the strip 56 to be clinched between the end flange 16 and the thrust plate 32. This retains the anchor 10 assembled with and projecting through the plastic strip. If desired, the plastic strip 56 may have small holes aligned with the nail holes in the thrust plate 32. In any event, assuming that the holes 55 in the plastic strip 56 are equally spaced, it will be apparent that the longitudinal axes of the respective casings 12 (and the chucks 20 therein) will be substantially perpendicular to the strip 56. Therefore, if a series of anchors 10 are assembled with the strip 56, the anchors may be nailed to the form end 4, as shown in FIG. 2, by simply extending the strip 56 until it is parallel with the form 4 and then nailing the nails 34 into the form 4. Of course, the first anchor 10 that is nailed in place must be carefully positioned, but in nailing subsequent anchors to the form 4 the strip 56 maintains the desired predetermined spacing between the anchors 10.

The live end anchors 36 are similarly mounted on a strip 57 that is similar to the plastic strip 56. The strip 57 is perforated with like holes 55 so as to be clinched or held between the thrust plate 48 and the radial end flange 46. As shown in FIG. 6, the assembly of the live end anchors and the plastic strip 57 also includes the resilient spacers 52, each being bonded to its associated end flange 46.

If the live end anchors are nailed in place last, the first live end anchor 36 that is nailed should be aligned axially with its associated dead end anchor 10. If the spacing of the live end anchors 36 on the strip 57 is the same as the spacing of the dead end anchors 10 on the strip 56, the nailing of subsequent live end anchors 36 in place will result in those live end anchor being respectively axially aligned with their associated dead end anchors. Also when each live end anchor is nailed in place, spacer 52 yields so as to seal against the inside surface of the form 2, as shown in FIG. 3.

After the groups of anchors 10, 36 have been mounted in place, the tendons 8 may be installed. In this regard it should be noted that each tendon 8 is encased in a vinyl sheath 60, and the external surface of the tendon 8 may be greased so that the tendon is capable of longitudinal movement within the sheath 60. A short length of the sheath 60 is cut off, degreased, and then a pilot cup 62 (FIG. 2) is installed over the end of the tendon. This pilot cup holds the jaws of the chuck 20 open until the tendon is properly seated within the anchor 10. The tendon with pilot cup 62 is inserted into the smaller diameter end of the casing 12 a sufficient distance so that the pilot cup 62 moves a short distance past the cup 28. A covering sleeve of tape 64 is then wrapped around the sheath 60 and the smaller diameter end of the casing 12 to seal the gap between the casing and the sheath.

The sheath and tendon are then extended to span the gap between the forms 2, 4 plus about two feet beyond form 2 where the tendon and sheath are cut. Thereafter, the sheath 60 is cut away at a point that is quite close to the smaller diameter end of the live end anchor casing 38 and degreased. The tendon 8 is then fed into the smaller diameter end of the casing 38 and through the chuck 40 and bore 54 in the spacer 52 and also through a preformed hole 66 in the form 2 and outwardly therebeyond, as shown in FIG. 3. A washer 68 and coil spring 70 are then placed over the tendon 8 followed by a pretension anchor 72. The pretension anchor 72 is a known device containing jaws for gripping the cable and may be of a type shown in Schweitzer U.S. Pat. No. 3,098,275. Thereafter, the conventional center hole hammer 74, is placed over the tendon 8 and is moved back and forth to strike the prestressing anchor 72 which tends to pull the tendon 8 to the right (FIG. 3) so that the desired amount of prestressing of the tendon is effected. Thereafter, tape 76 is wrapped around the sheath and smaller diameter end of the casing 38 to span the gap therebetween. Conventionally, a pretensioning wedge and/or chain of the type shown in the aforesaid Kelly U.S. Pat. No. 3,399,434 may be used if desired.

When the slab 80 has been poured and the concrete has reached about 50 % of its ultimate strength, the anchor 72, spring 70, and washer 68 are removed from each of the tendons. The forms are stripped away and the spacer sealer 52 are pulled out of the concrete exposing the flanged ends of the live end anchors. The plastic strips 56, 57 remain embedded in the concrete along with the anchors 10, 36 and sheathed tendons.

In accordance with conventional techniques, a center hole electro-hydraulic jack is placed on each tendon to tension the tendon. When the jack is released the live end anchor chuck 40 will set and grip the tendon holding the latter at the desired tension.

The tendons are cut off at the holes left by the spacer sealers 52 after which those holes are filled with grout.

The invention is claimed as follows:

1. Apparatus for casting an posttensioning concrete comprising opposed forms between which concrete is cast, a plurality of tendon anchors adjacent to one of said forms, each anchor having a casing with a chuck therein for gripping a tendon, a flexible strip secured to the casings and positioning said casings at predetermined spacings and with the longitudinal axes of the respective casings being perpendicular to said strip, and means secured to said one form for positioning said strip and anchors in spaced relation to said one form and with the strip and said anchors being between said opposed forms, said means and said strip attaching said anchors as a group to said form to position automatically said anchors at said predetermined spacings, which predetermined spacings are substantially the same as the linear distances along said strip between said casings prior to securing said strip and casings to said form, and wherein said casing has an end flange, a thrust plate adjacent to said end flange, said strip is interposed between said thrust plate and end flange, and said securing means passes through said thrust plate and said strip.

2. Apparatus according to claim 1 in which said casing has a larger diameter end and a smaller diameter end, and said strip is at said larger diameter end.

3. The combination with a flexible strip of a series of tendon anchors, each anchor comprising a casing and a chuck in the casing, each casing having an end portion projecting through said strip such that the longitudinal axes of the casings are substantially perpendicular to the strip, and means for securing the strip to each casing at predetermined spacings of said axes to provide a group of tendon anchors preassembled with said strip so that the strip may be attached to a form of a concrete casting apparatus to space said anchors apart adjacent to said form automatically and with the strip being such as to locate said axes substantially at said predetermined spacings, and wherein each said end portion has a radial flange, a thrust plate surrounds each casing, and said strip is confined between the radial flanges and the thrust plates on the respective casings.

4. The combination according to claim 3 in which said casing has a bore tapering away from said strip, and said chuck is a jaw cluster within said bore.

5. The combination according to claim 3 including a tubular resilient spacer sealer coaxial with said casing and secured to said radial flange.

* * * * *